US008610012B2

(12) United States Patent
Liebetruth

(10) Patent No.: US 8,610,012 B2
(45) Date of Patent: Dec. 17, 2013

(54) ELECTRICAL SWITCH OPERABLE THROUGH BOTH MANUAL AND MOTOR DRIVEN OPERATIONS

(75) Inventor: Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 183 days.

(21) Appl. No.: 13/219,738

(22) Filed: Aug. 29, 2011

(65) Prior Publication Data

US 2012/0048695 A1 Mar. 1, 2012

(30) Foreign Application Priority Data

Aug. 30, 2010 (DE) ..... 10 2010 036 222

(51) Int. Cl.
*H01H 9/00* (2006.01)

(52) U.S. Cl.
USPC ..... 200/308; 200/330

(58) Field of Classification Search
USPC ..... 200/308, 329, 330, 50.26; 361/115; 335/68
IPC ..... H01H 2003/3078,3/30, 73/14
See application file for complete search history.

(56) References Cited

U.S. PATENT DOCUMENTS 3,806,684 A * 4/1974 Hauser ..... 200/400
4,885,444 A * 12/1989 Lazar et al. ..... 200/401
4,894,796 A * 1/1990 Engel et al. ..... 345/559
5,422,453 A * 6/1995 Smith et al. ..... 200/329
5,661,627 A 8/1997 Liebetruth et al.
7,019,240 B2 * 3/2006 Eberts et al. ..... 200/331
7,115,823 B1 * 10/2006 Anaya-Burgos ..... 200/43.01

FOREIGN PATENT DOCUMENTS

DE 4333828 C1 3/1995
DE 19957391 C1 3/2001
DE 20121223 U1 3/2003
DE 19803975 B4 1/2006
EP 0997919 B1 2/2006

OTHER PUBLICATIONS

Schalter der Firma Siemens Molded Case Circuit Breaker Typbezeichnung BYD oder CYD Prospekt S.1-8; Others.
German Search Report for German Application No. 10 2010 036 222.0 dated Aug. 12, 2010.
Certified German Priority document for German Application No. 10 2010 036 222.0 filed Aug. 30, 2010 (Not Yet Published).

* cited by examiner

*Primary Examiner* — Vanessa Girardi
(74) *Attorney, Agent, or Firm* — Harness, Dickey & Pierce, P.L.C.

(57) ABSTRACT

An arrangement includes an electrical switch which has a handle that can assume at least three different positions, namely an ON position, an OFF position and a TRIPPED position, and a motor drive that is mounted on said switch and is provided for the purpose of activating the handle. According to an embodiment of the invention, provision is made for the motor drive to feature a motor-drive-specific indicator entity which indicates whether the switch can be closed by way of the motor drive, wherein the motor-drive-specific indicator entity is connected to at least one switch-specific actuator and to at least one motor-drive-specific actuator, and indicates a closure-unreadiness of the arrangement if at least one of the actuators signals a closure-unreadiness.

18 Claims, 6 Drawing Sheets

ELECTRICAL SWITCH OPERABLE THROUGH BOTH MANUAL AND MOTOR DRIVEN OPERATIONS

PRIORITY STATEMENT

The present application hereby claims priority under 35 U.S.C. §119 on German patent application number DE 10 2010 036 222.0 filed Aug. 30, 2010, the entire contents of which are hereby incorporated herein by reference.

FIELD

At least one embodiment of the invention generally relates to an arrangement comprising an electrical switch which has a handle that can assume at least three different positions, namely an ON position, an OFF position and a TRIPPED position, said switch having a motor drive that is mounted thereon for the purpose of activating the handle. At least one embodiment of switches having a corresponding handle are marketed by the firm Siemens under the designation "Molded Case Circuit Breaker" with the type designations BQD or CQD.

SUMMARY

In at least one embodiment, the invention addresses the problem of achieving greater user-friendliness in the context of an arrangement.

This problem is solved according to at least one embodiment of the invention by way of an arrangement. Advantageous embodiments of the arrangement according to the invention are specified in the subclaims.

Accordingly, provision is inventively made in at least one embodiment for the motor drive to feature a motor-drive-specific indicator entity, which indicates whether the switch can be closed by way of the motor drive, wherein the motor-drive-specific indicator entity is connected to at least one switch-specific actuator and at least one motor-drive-specific actuator, and indicates a closure-unreadiness of the arrangement if at least one of the actuators signals a closure-unreadiness.

BRIEF DESCRIPTION OF THE DRAWINGS

The invention is explained in greater detail below with reference to example embodiments, wherein:

FIG. 1, and FIGS. 6-7 show the example embodiment as per FIG. 5 having different settings of the motor-drive-specific indicator entity.

Figure 1:
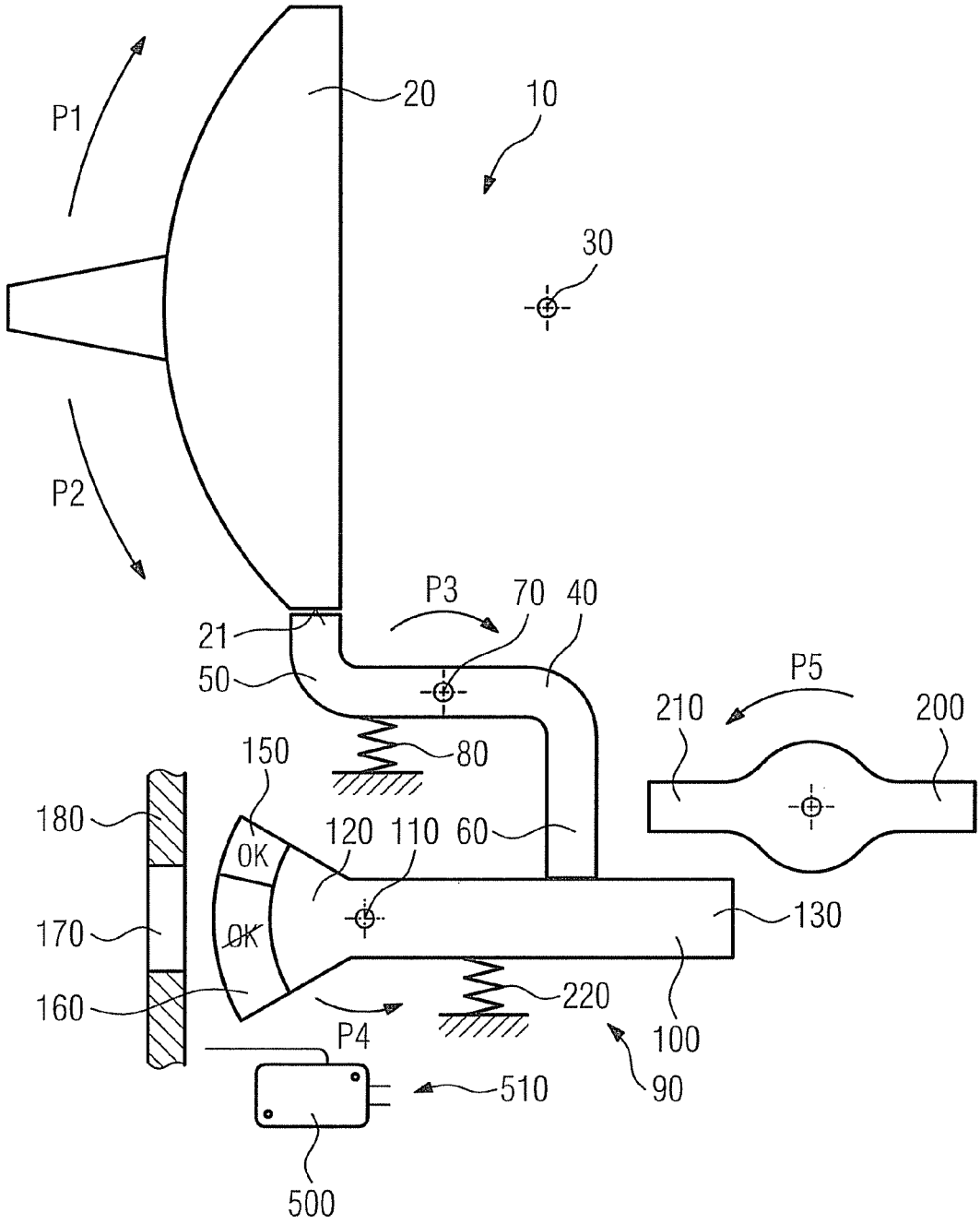
FIG. 1 shows components of a first example embodiment of an electrical switch which can be used in the context of an arrangement according to an embodiment of the invention.

For the sake of clarity, the same reference signs are always used in the figures for identical or comparable components.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows components of an electrical switch 10 which is equipped with a handle 20. The handle 20 can assume three different positions, namely an upper ON position, a lower OFF position and an intermediate TRIPPED position. FIG. 1 shows the handle 20 in a central position, which corresponds to the TRIPPED position. In the TRIPPED position of the handle 20, the switch 10 is in a state in which an internal or external opening mechanism has tripped and opened the switch 10.

By way of pivoting the handle 20 downwards in the arrow direction P2 about a rotational axis 30, the handle 20 can be moved from the central TRIPPED position that is illustrated in FIG. 1 to its lower OFF position. From there, the handle 20 can be pivoted upwards in the arrow direction P1—past the central TRIPPED position illustrated in FIG. 1—to its upper ON position, whereby the electrical switch 10 is closed. The pivoting of the handle 10 is effected in each case by pivoting about the rotational axis 30.

The handle 20 interacts with an intermediate lever 40, this having a lever arm 50 which is shown on the left-hand side in FIG. 1 and a lever arm 60 that is shown on the right-hand side in FIG. 1. The intermediate lever 40 is so mounted that is can be pivoted about a rotational axis 70. A compression spring 80, which exercises a spring force F1, is connected to the left-hand lever arm 50 of the intermediate lever 40 and effects a rotational moment which attempts to rotate the intermediate lever 40 in the arrow direction P3 about the rotational axis 70.

In addition, FIG. 1 shows a switch-specific indicator entity 90 comprising an indicator lever 100, which is so mounted as to be rotatable about a rotational axis 110 and features a first lever arm 120 and a second lever arm 130. Attached to the first lever arm 120 is an indicator element 150, which indicates the closure-readiness of the switch 10 by means of an "OK" sign. In addition, the first lever arm 120 is equipped with a further indicator element 160, which indicates the closure-unreadiness of the electrical switch 10 by way of a corresponding sign that is struck through. As a result of pivoting the indicator lever 100 about the rotational axis 110, either the first indicator element 150 or the further indicator element 160 can be positioned in front of a window 170 of an operating wall 180. In this way, the indicator lever 100 and the operating wall 180 with the window 170 form an indicator entity of the electrical switch.

In addition to the handle 20 acting as an actuator, the electrical switch 10 is equipped with a further actuator 200 which can interact with the indicator lever 100. The further actuator 200 can be the tripping arbor of the switch 10, for example, wherein said tripping arbor can push on the second lever arm 130 of the indicator lever 100 by way of a control cam 210.

It can also be seen from FIG. 1 that the indicator lever 100 is coupled to a compression spring 220, which exercises a spring force F2 on the second lever arm 130 of the indicator lever 100 and attempts to rotate this in the arrow direction P4. The spring force of the compression spring 80 is dimensioned such that the intermediate lever 40 can rotate the indicator lever 100 against the spring force of the compression spring 220 by virtue of the geometry in place.

There follows an example explanation of the way in which the electrical switch 10 as per FIG. 1 functions:

In the TRIPPED position of the handle 20 as illustrated in FIG. 1, the compression spring 80 will rotate the left-hand lever arm 50 of the intermediate lever 40 in the arrow direction P3, such that the right-hand lever arm 60 pushes on the second lever arm 130 of the indicator lever 100 and rotates this against the arrow direction P4. As a consequence, the further indicator element 160 is positioned in front of the window 170 of the operating wall 180 and an operator of the electrical switch 10 can recognize that the electrical switch 10 is not-closable, or closure-unready.

If the handle 20 is pivoted upwards in the arrow direction P1 from the TRIPPED position into the ON position, nothing changes in respect of the switching position of the indicator lever 100, specifically because the compression spring 80 will continue to push the left-hand lever arm 50 upwards and hence the right-hand lever arm 60 onto the indicator lever 100. The further indicator element 160, which indicates that the switch is closure-unready (or not-closable), therefore continues to be displayed in this case.

Only in the lower OFF position of the handle 20, i.e. when the handle 20 is pivoted downwards in the arrow direction P2, is it possible for the first indicator element 150 to be displayed. In such an event, a lower limit stop 21 of the handle 20 will actually push on the left-hand lever arm 50 and swivel the intermediate lever 40 against the arrow direction P3. As a result of this, the right-hand lever arm 60 will no longer push the second lever arm 130 down and force the display of the further indicator element 160. The indicator lever 100 can therefore pivot in the arrow direction P4 as a result of the spring force of the compression spring 220, and cause the first indicator element 150 to be displayed, unless the further actuator 200 intervenes and prevents such a changeover.

The further actuator 200 can also act on the setting of the indicator lever 100: specifically, if the control cam 210 of the further actuator 200 pushes on the second lever arm 130 as a result of swiveling in the arrow direction P5, the indicator lever 100 is swiveled against the arrow direction P4 such that the further indicator element 160 is positioned in front of the window 170 and the closure-unreadiness of the switch 10 is indicated.

It can be seen from the explanations above that the second lever arm 130 of the indicator lever 100 acts as a mechanical OR element, which always causes a closure-unreadiness of the switch 10 to be indicated if either the handle 20 or a further actuator signals a closure-unreadiness of the switch. Only in the event that neither the handle 20 nor any further actuator 200 acts on the indicator lever 100, can the indicator lever 100 be pushed upwards in the arrow direction P4 by the compression spring 220 and made to display the first indicator element 150.

In the case of the example embodiment according to FIG. 1, two actuators act on the indicator lever 100, specifically the handle 20 and the further actuator 200. Alternatively, the electrical switch can also be equipped with more than two actuators.

Figure 2:
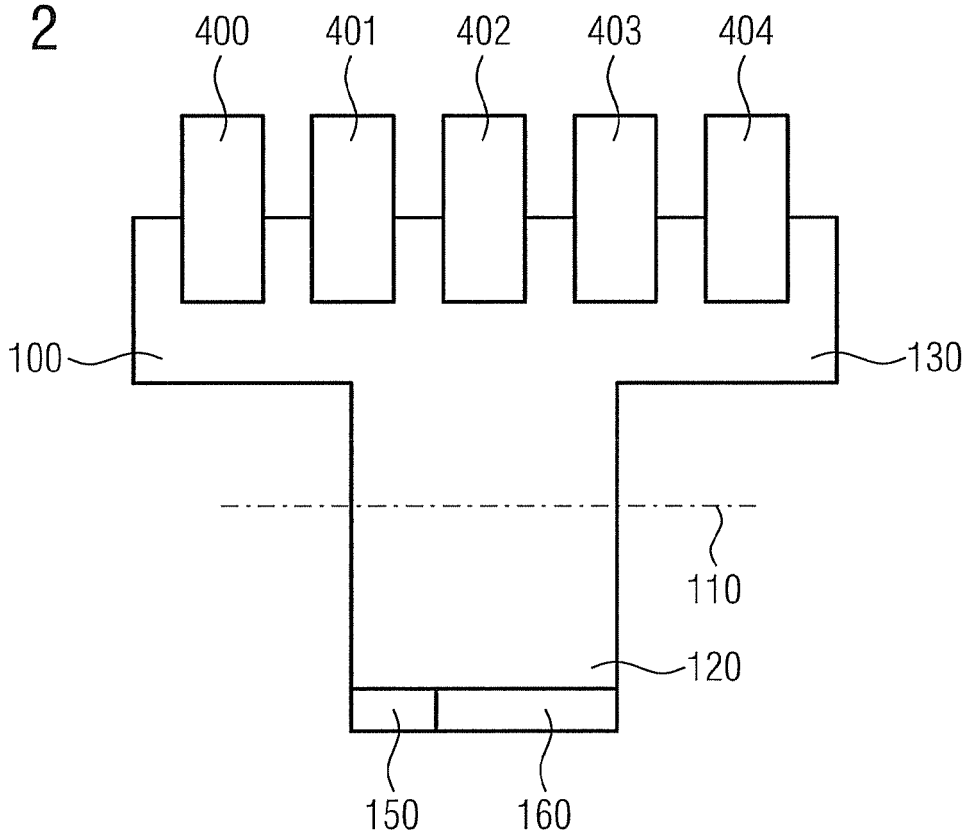
FIG. 2 shows a different example embodiment of an indicator entity which can be used in the context of the switch as per FIG. 1.

FIG. 2 exemplifies an embodiment of the switch comprising more than two actuators. Evident in FIG. 2 is the indicator lever 100, whose second lever arm 130 is very wide when observed from above, such that it can interact with a multiplicity of actuators 400, 401, 402, 403 and 404. If one of these actuators 400 to 404 acts on the second lever arm 130 and swivels this about the rotational axis 110, the position of the first lever arm 120 is also changed and the indicator element which is visible in front of the window 170 (cf. FIG. 1) of the switch 10 can be adjusted, specifically such that the further indicator element 160 signaling the closure-unreadiness of the switch becomes visible.

In addition, the indicator lever 100 can be coupled to a switching element 500 which allows the closure-readiness or the closure-unreadiness to be read out externally via an electrical interface 510. Using such a switching element 500, the electrical switch 10 can be monitored and controlled by a supervisory control unit, for example.

Figure 3:
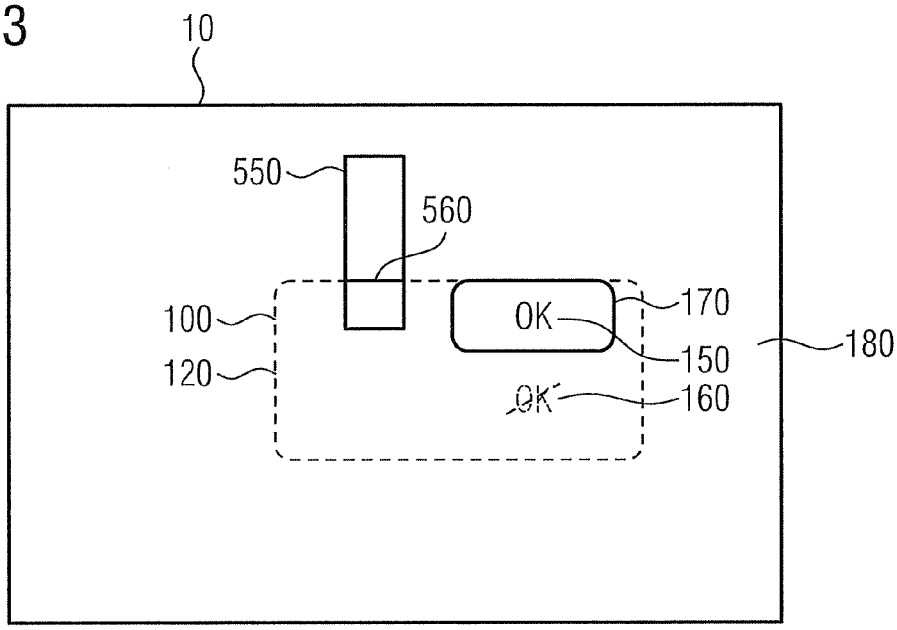
FIG. 3 shows the switch as per FIG. 1 in a front view when a closure-readiness is indicated.

FIG. 3 exemplifies the electrical switch 10 as per FIGS. 1 and 2 in a front view when closure-readiness is indicated. The operating wall 180 forming a front wall of the housing of the switch 10 can be seen, as can the window 170 in the operating wall 180, through which the indicator element 150 of the indicator lever 100 is visible.

The other indicator element 160 of the indicator lever 100 is not visible because it is concealed by the operating wall 180. Consequently, of the lever arm 120 of the indicator lever 100 shown in FIG. 3, only those sections which are situated behind the window 170 and behind a control window 550 are visible.

It can be seen in Figure that a section of the top edge 560 of the lever arm 120 of the indicator lever 100 is visible in the control window 550 and can be accessed externally through the control window 550. The setting of the lever arm 120 can therefore be "sensed" externally, e.g. by placing a sensor arm (not shown in FIG. 3) through the control window 550 onto the top edge 560 of the lever arm 120.

Figure 4:
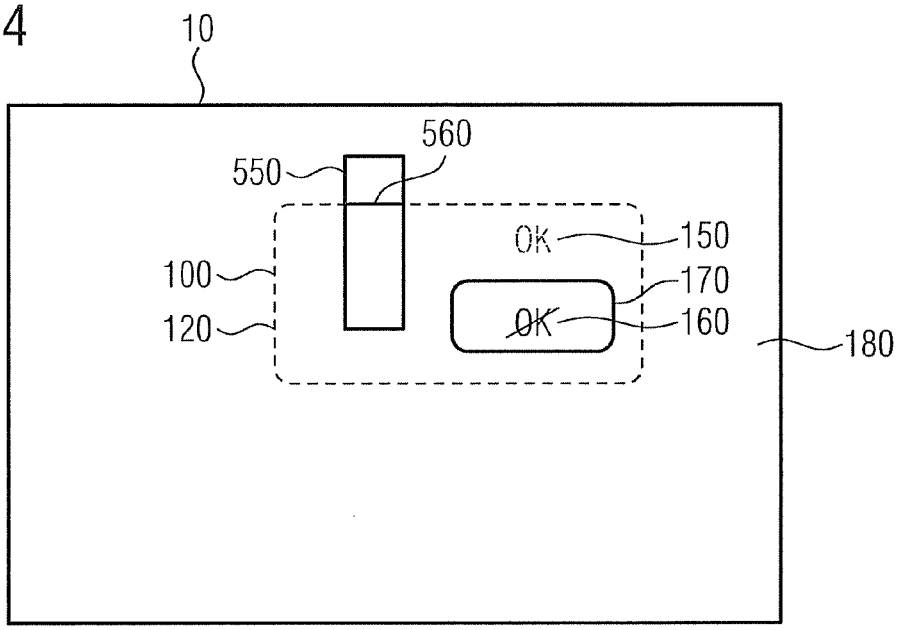
FIG. 4 shows the switch as per FIG. 1 in a front view when a closure-unreadiness is indicated.

FIG. 4 exemplifies the front view of the switch 10 after the lever arm 120 has been pivoted upwards, such that the indicator element 160 instead of the indicator element 150 is positioned in front of the window 170. It is moreover evident that the position of the top edge 560 of the lever arm 120 has moved accordingly and is now situated higher up in the control window 550.

Figure 5:
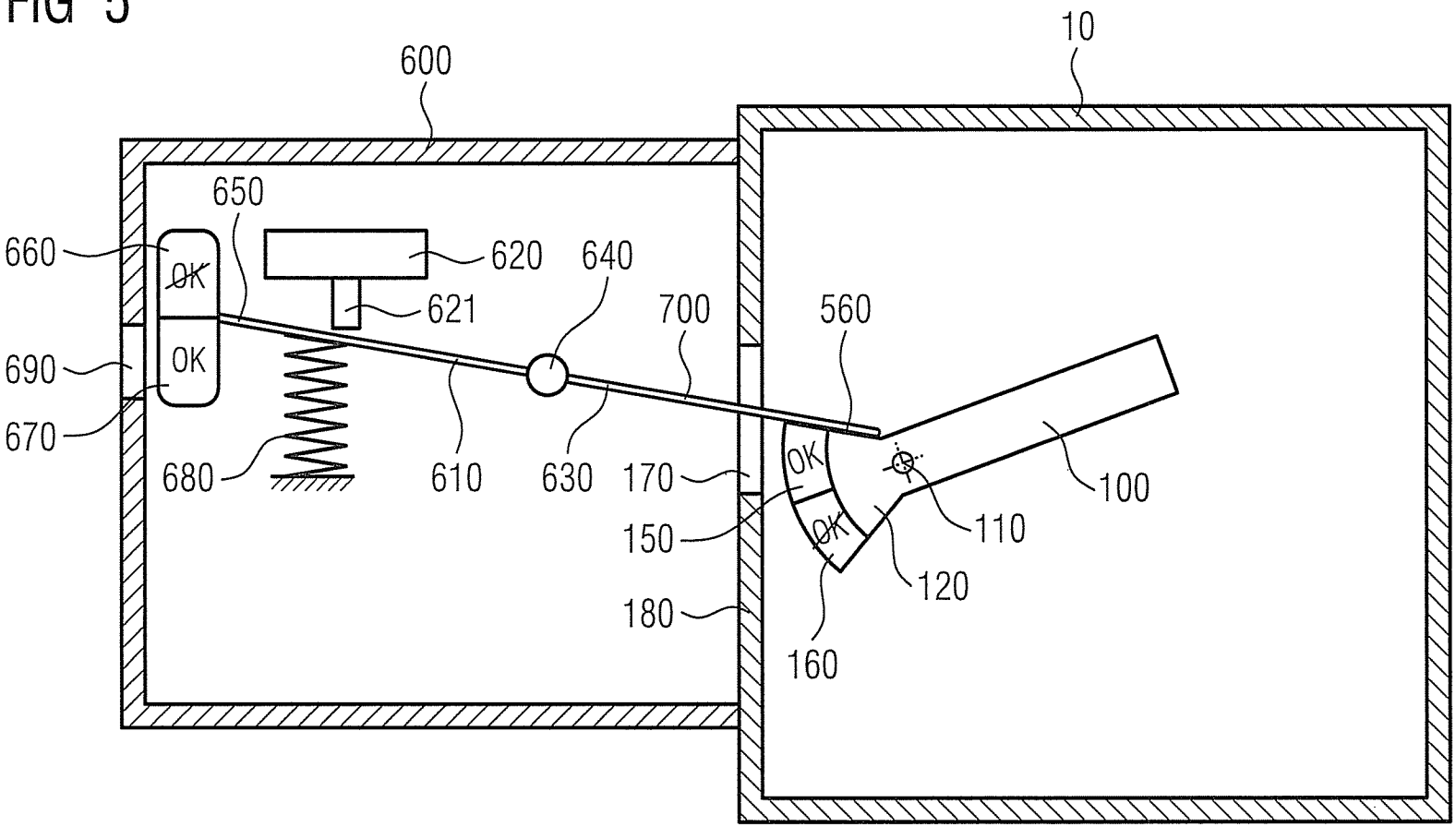
FIG. 5 shows an example embodiment of an arrangement according to an embodiment of the invention on the basis of the switch as per

FIG. 5 shows the switch 10 as per FIGS. 1 to 4, after a motor drive 600 has been mounted onto the operating wall 180 of the switch 10. A motor-drive-specific indicator entity 610 that interacts with a motor-drive-specific actuator 620 can be seen.

The motor drive 600 features a spring for storing mechanical drive energy for the purpose of adjusting the handle 20 (cf. FIG. 1) of the switch 10. The spring state of this spring is detected by the motor-drive-specific actuator 620. Depending on the state of the spring, an actuator element 621 of the motor-drive-specific actuator 620 is extended or retracted. In the illustration as per FIG. 5, the spring is loaded and the actuator element 621 is retracted accordingly, such that it assumes the setting that is illustrated in FIG. 3.

FIG. 5 moreover shows a motor-drive-specific indicator lever 630 of the indicator entity 610, which lever can be pivoted about a rotational axis 640. The motor-drive-specific indicator lever 630 features a lever arm 650 to which is attached an indicator element 660 and an indicator element 670. Depending on the displacement angle of the indicator lever 630, either the indicator element 660 or the indicator element 670 is visible in front of a window 690 of the motor drive 600.

The indicator lever 630 interacts with a compression spring 680, which pivots the lever arm 650 upwards in the case of the illustration as per FIG. 3 and causes the indicator element 670 to be displayed.

FIG. 5 moreover shows that the other lever arm 700 of the indicator lever 630 reaches through the control window 550 (cf. FIGS. 3 and 4) in the operating wall 180 of the switch 10 and rests on the top edge 560 of the lever arm 120 of the switch-specific indicator lever 100.

As a result of this, the switch-specific indicator lever 100 can influence the setting of the motor-drive-specific indicator entity 610; the switch-specific indicator lever 100 therefore forms a switch-specific actuator of the arrangement for the motor-drive-specific indicator entity 610.

For the sake of clarity, of the switch-specific indicator entity of the switch 10, only the switch-specific indicator lever 100, which can be rotated about the rotational axis 110, is illustrated. Also illustrated is the lever arm 120, to whose end are attached the indicator elements 150 and 160.

In the illustration as per FIG. 5—as mentioned above—it is assumed by way of example that the spring for storing mechanical drive energy in the motor drive 600 is loaded, and that the spring-state-dependent actuator 620 moves the actuator element 621 accordingly to the setting that is illustrated in the FIG. 5. In this setting, the lever arm 650 of the indicator lever 630 can be pushed upwards by the compression spring 680, whereby the indicator element 670 becomes visible in front of the window 680 of the motor drive.

However, the setting of the indicator lever 630 as illustrated in the FIG. 5 is only possible because the lever arm 120 of the switch-specific indicator lever 100 is pivoted downwards and the indicator element 150 is visible in front of the window 170 of the switch 10. Only in this switch setting is the top edge 560 of the lever arm 120 actually situated in a lower position, such that the compression spring 680 can pivot the lever arm 650 upwards and cause the indicator element 670 to be displayed.

Figure 6:
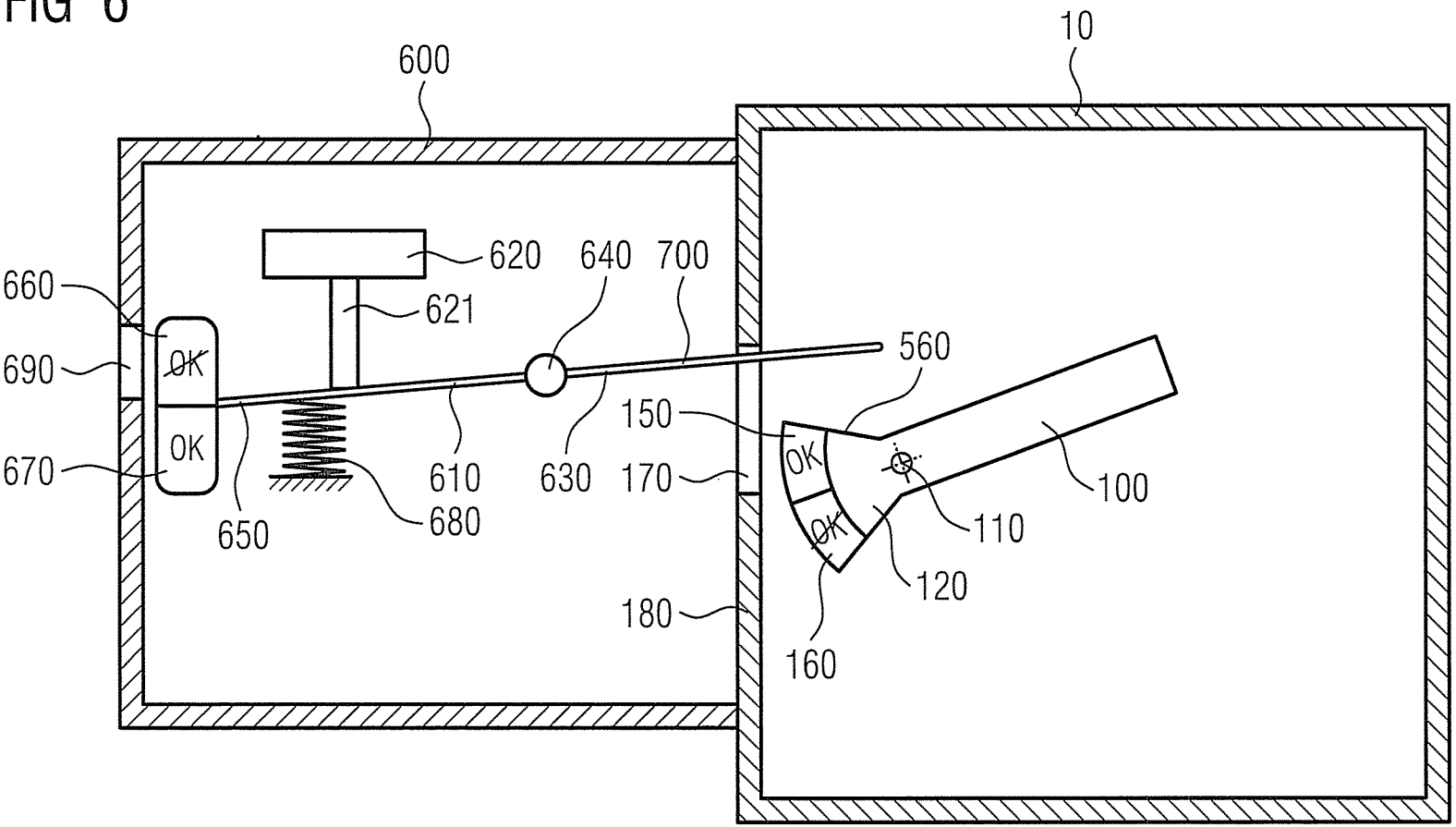

FIG. 6 exemplifies the arrangement comprising the motor drive 600 and the electrical switch 10, after the spring for storing mechanical drive energy in the motor drive 600 has been unloaded and the actuator element 621 has assumed the setting that is illustrated in FIG. 6. In this setting, the actuator element 621 pushes the lever arm 650 downwards against the spring force of the compression spring 680, whereby the indicator element 660 instead of the indicator element 670 is positioned in front of the window 690. The setting of the switch-specific indicator lever 100 or the position of the top edge 560 of the lever arm 120 is irrelevant in this case; it can therefore be seen that the lever arm 700 no longer rests on the top edge 560 of the lever arm 120, but is separate from this.

Figure 7:
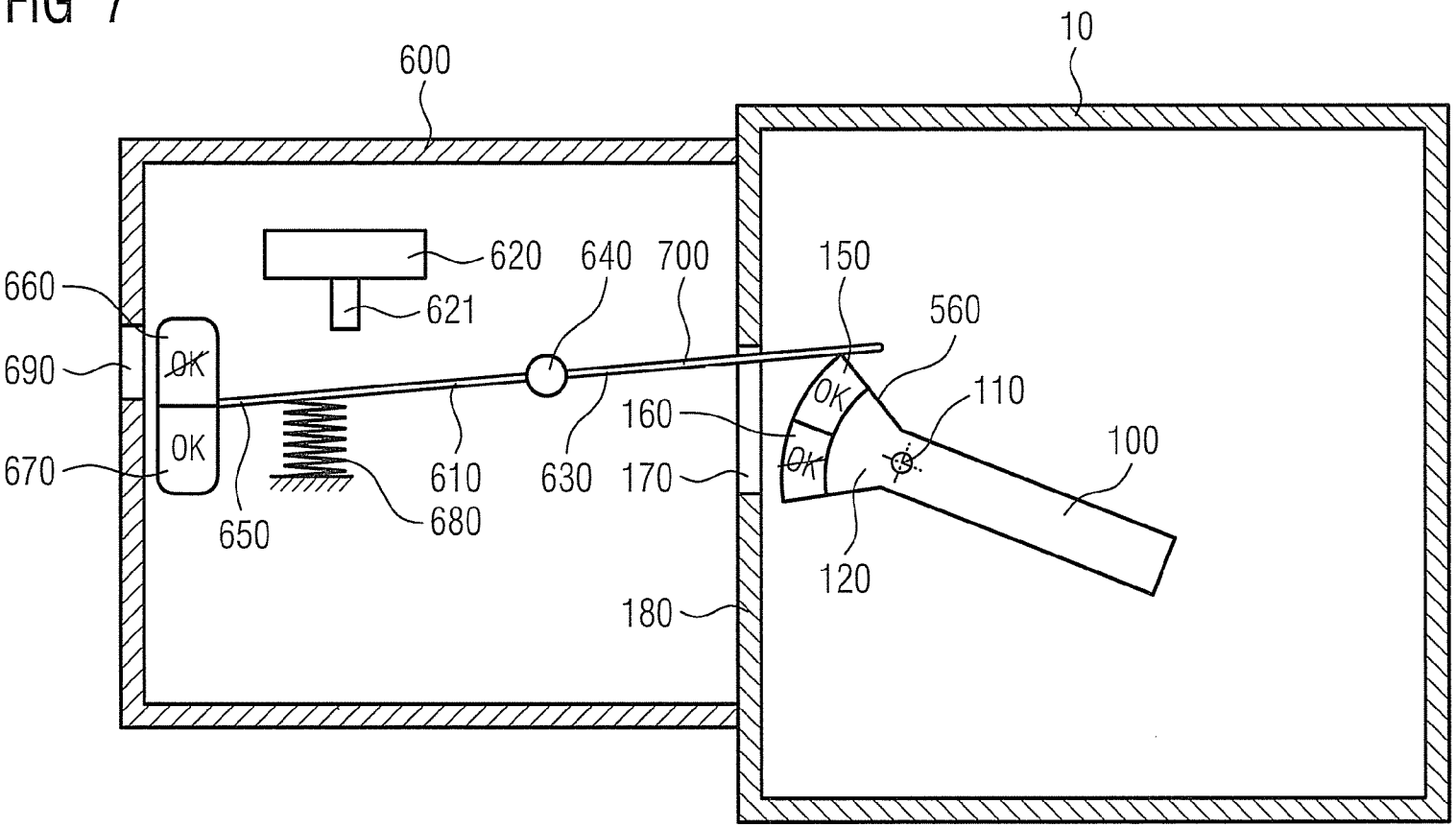

In the illustration as per FIG. 7, it is assumed by way of example that the spring for storing mechanical drive energy in the motor drive 600 is loaded and that the actuator element 621 consequently assumes the setting explained above in connection with FIG. 5, in which it has no influence on the position of the lever arm 650. In the illustration as per FIG. 7—in contrast with FIG. 5—it is however assumed that the lever arm 120 of the switch-specific indicator lever 100 is pivoted upwards and that the indicator element 160 is positioned in front of the window 170. In this setting of the lever arm 120, the top edge 560 pushes the lever arm 700 of the indicator lever 630 upwards against the spring force of the compression spring 680, such that the indicator element 660 is positioned in front of the window 690. The setting of the actuator element 621 is irrelevant in this case.

In summary, it can be seen that the indicator lever 630 of the motor-drive-specific indicator entity 610 forms a logical OR element, which positions the indicator element 660 in front of the window 690 of the motor drive 600 if either the actuator element 621 presses on the lever arm 650 or the lever arm 120 pivots the lever arm 700 upwards. Only in the event that the spring for storing mechanical drive energy of the motor drive 600 is loaded, i.e. the actuator element 621 assumes the position shown in FIG. 5, and at the same time the lever arm 120 of the switch 10 is pivoted downwards and the indicator element 150 is positioned in front of the window 170, will the indicator element 670 be displayed in front of the window 690.

In addition to the window 690 which displays the setting of the indicator lever 630, the motor drive 600 can feature additional display windows by means of which further displays are possible. For example, the setting of the handle 20 of the switch 10 (cf. FIG. 1) and/or the setting of the actuator element 621 or the state of the motor-drive-specific actuator 620, which establishes the spring state of the spring for storing mechanical drive energy, can be displayed in a further window.

The arrangement according to at least one embodiment of the invention has an essential advantage in that operator activation of the motor drive and therefore initiation of the switch closure can be prevented if a closure-unreadiness of the arrangement is recognized and is indicated by way of the motor-drive-specific indicator entity.

The motor-drive-specific indicator entity can be connected directly and/or indirectly to one or more switch-specific actuators, e.g. to:

an undervoltage trip;

a trip magnet for remote tripping of the electrical switch;

a readout which indicates the travel position of the switch at or in a slot;

a locking sensor which indicates locking with one or more other electrical switches;

a test actuator which indicates the existence or operational readiness of an overcurrent trip entity of the electrical switch;

a tripping arbor which signals a closure-unreadiness of the switch when said arbor assumes a position and/or setting in which closure of the electrical switch is not possible or not desirable;

an entity which recognizes "welded" contacts of the electrical switch, wherein such an entity can comprise e.g. the switching arbor, switching arbor segments and/or contact levers of the switch;

an actuator which recognizes the latching state of the electrical switch, wherein such an actuator can comprise e.g. an opening arbor of the switch latch of the electrical switch;

a collective shaft of the switch for detecting the latching status of the switch, and/or an actuator which checks whether an outstanding tripping signal of an overcurrent trip or short-circuit trip is present.

According to an example embodiment of the arrangement, provision is made for the switch to have a switch-specific indicator entity which indicates the closure-readiness of the switch or the closure-unreadiness of the switch, and for the switch-specific indicator entity to form the at least one switch-specific actuator which is connected to the motor-drive-specific indicator entity. By virtue of this configuration, various switch-related actuators that are used to signal the closure-readiness or closure-unreadiness of the switch can be indirectly linked in an advantageous manner via the switch-specific indicator entity alone.

The switch-specific mechanical actuators are preferably connected to the switch-specific indicator entity in such a way that each actuator can individually trigger an indication of the closure-unreadiness of the switch by activating the indicator entity correspondingly.

The switch-specific indicator entity is preferably coupled mechanically to the handle. The switch-specific indicator entity preferably indicates the closure-unreadiness of the switch when the handle is not in the OFF position. The switch-specific indicator lever is preferably pivoted into the "closure-unready" lever setting—directly via the handle or indirectly via an intermediate component which is coupled to the handle, for example—when the handle assumes the ON position or the TRIPPED position.

If the motor drive has a spring for storing mechanical drive energy, it is considered advantageous for the at least one motor-drive-specific actuator to be a spring-state-dependent actuator which indicates the spring state of the spring.

The motor-drive-specific indicator entity preferably has an indicator lever whose displacement angle indicates the display of the closure-readiness or the closure-unreadiness of the arrangement. The motor-drive-specific indicator lever is preferably pivoted into the "not-closable" lever setting when the switch-specific indicator entity indicates the closure-unreadiness of the switch.

In addition to the handle as an actuator, the switch-specific indicator entity preferably interacts with at least one further switch-specific actuator which can move the switch-specific indicator entity into the "not-closable" setting. The switch-specific indicator entity preferably has a mechanical OR element, which moves the switch-specific indicator entity into the "not-closable" setting when the handle or at least one of the further mechanical actuators signals closure-unreadiness.

According to an example embodiment of the arrangement, provision is made for the switch-specific indicator entity to feature a switch-specific indicator lever whose displacement angle or displacement state determines the display of the closure-readiness of the switch or the closure-unreadiness of the switch, for the motor-drive-specific indicator entity to feature a motor-drive-specific indicator lever whose displacement angle determines the display of the closure-readiness of the arrangement or the closure-unreadiness of the arrangement, and for the motor-drive-specific indicator lever to be coupled to the switch-specific indicator lever and pivoted into the "closure-unready" setting when the switch-specific indicator lever is pivoted into the "closure-unready" setting.

It is also considered advantageous for a lever arm of the switch-specific indicator lever to have an indicator element for indicating the closure-readiness or the closure-unreadiness of the switch, and for a lever arm of the motor-drive-specific indicator lever to have an indicator element for indicating the closure-readiness or the closure-unreadiness of the arrangement. The or a second lever arm of the indicator lever is preferably coupled mechanically to the handle.

The OR element of the switch-specific indicator entity can take the form of the second lever arm of the switch-specific indicator lever, for example. The second lever arm can preferably be pivoted by means of the handle and any further mechanical actuator for signaling closure-unreadiness, and move the switch-specific indicator lever into the "closure-unready" setting.

Moreover, the switch-specific indicator entity is preferably coupled to a switching element which allows the closure-readiness or the closure-unreadiness to be read out externally via an electrical interface. Such a switching element therefore allows monitoring and control of the electrical switch via a supervisory control unit, for example.

Moreover, it is considered advantageous to prevent any mechanical or electrical attempt by the motor to close the switch when in the "not-closable" state, by way of a corresponding mechanical decoupling of the mechanical or electrical ON instruction. This can be effected in an advantageous manner by providing a mechanical coupling element between the ON button or ON magnet and the active element for relaying the ON instruction to the motor drive. The coupling element is controlled directly or indirectly by the closure-readiness indicator in this case.

The switch preferably has a housing of cast or molded material.

In the context of an electrical switch, provision is preferably made for the ON position of the handle to indicate that the switch is closed, for the OFF position of the handle to indicate that the switch is open or should be open, and for the TRIPPED position to indicate that an internal or external opening mechanism has tripped and that the switch has been opened by the opening mechanism. Furthermore, the switch is preferably designed in such a way that, starting from the TRIPPED position, the handle for closing the switch must first be moved into the OFF position and then into the ON position.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE SIGNS

10 Switch
20 Handle
21 Limit stop
30 Rotational axis
40 Intermediate lever
50 Lever arm
60 Lever arm
70 Rotational axis
80 Compression spring
90 Indicator entity
100 Indicator lever
110 Rotational axis
120 Lever arm
130 Lever arm
150 Indicator element
160 Indicator element
170 Window
180 Operating wall
200 Actuator
210 Control cam
220 Compression spring
400 Actuator
401 Actuator
402 Actuator
403 Actuator
404 Actuator
410 Rotational axis
500 Switching element
510 Electrical interface
550 Control window
560 Top edge
600 Motor drive
610 Indicator entity
620 Actuator
621 Actuator element
630 Indicator lever
640 Rotational axis
650 Lever arm
660 Indicator element
670 Indicator element
680 Compression spring
690 Window
700 Lever arm
F1 Spring force
F2 Spring force
P1 Arrow direction
P2 Arrow direction
P3 Arrow direction
P4 Arrow direction
P5 Arrow direction

What is claimed is:

1. An electrical switch comprising:

a handle, assumable in at least three different positions, the at least three different positions including an ON position, an OFF position and a TRIPPED position;

a housing including a front wall, the front wall having an indicator window and a control window and forming an interface that is connectable to a motor drive for activation of the handle; and a switch-specific indicator entity configured to indicate a closure-readiness of the switch or a closure-unreadiness of the switch, wherein said switch-specific indicator entity is located inside the housing and is visible through the indicator window in the front wall, and said housing is configured to receive an insertable part of a motor-drive-specific indicator entity through said control window such that the insertable part of the motor-drive-specific indicator entity is coupled to said switch-specific indicator entity in order to communicate a setting of the switch-specific indicator entity.

2. An arrangement, comprising:

an electrical switch, the electrical switch including, a handle, assumable in at least three different positions, the at least three different positions including an ON position, an OFF position and a TRIPPED position, a switch-specific indicator entity configured to indicate a closure-readiness of the switch and a closure-unreadiness of the switch, and a housing including an operating wall, the operating wall forming a connectable interface; and a motor drive mounted on the connectable interface and configured to activate the handle, the motor drive including a motor-drive-specific indicator entity to indicate whether the switch is closable via the motor drive, the motor-drive-specific indicator entity being connectable to at least one switch-specific actuator that indicates a readiness of the switch and to at least one motor-drive-specific actuator that indicates a readiness of the motor drive, said motor-drive-specific indicator entity indicating a closure-unreadiness of the arrangement if at least one of the at least one motor-drive-specific actuator and the at least one switch-specific-actuator signals a closure-unreadiness, wherein the switch-specific indicator entity forms said at least one switch-specific actuator, and the operating wall of the housing of the switch includes a control window through which a part of the motor-drive-specific indicator entity is inserted and coupled to said switch-specific indicator entity, said switch-specific indicator entity being located inside said housing.

3. The arrangement as claimed in claim 2, wherein the switch-specific indicator entity is mechanically coupled to the handle, and wherein the switch-specific indicator entity indicates the closure-unreadiness of the switch when the handle is not in the OFF position.

4. The arrangement as claimed in claim 2, wherein the motor drive includes a spring for storing mechanical drive energy, the at least one motor-drive-specific actuator is a spring-state-dependent actuator which indicates the spring state of the spring, the motor-drive-specific indicator entity indicates that the arrangement is closure-unready if the spring is unloaded or the switch-specific indicator entity indicates closure-unreadiness of the switch, and the motor-drive-specific indicator entity indicates that the arrangement is closure-ready if the spring is loaded and the switch-specific indicator entity indicates closure-readiness of the switch.

5. The arrangement as claimed in claim 2, wherein the motor drive includes a spring for storing mechanical drive energy, and wherein the at least one motor-drive-specific actuator is a spring-state-dependent actuator which indicates a spring state of the spring.

6. The arrangement as claimed in claim 2, wherein the switch-specific indicator entity includes a switch-specific indicator lever whose displacement angle determines the display of the closure-readiness of the switch or the closure-unreadiness of the switch, wherein the motor-drive-specific indicator entity includes a motor-drive-specific indicator lever whose displacement angle determines the display of the closure-readiness of the arrangement or the closure-unreadiness of the arrangement, and wherein the motor-drive-specific indicator lever is coupled to the switch-specific indicator lever such that the motor-drive-specific indicator is pivoted into the "closure-unready" setting when the switch-specific indicator lever is pivoted into the "closure-unready" setting.

7. The arrangement as claimed in claim 2, wherein the motor-specific indicator lever is coupled to switch-related actuators which act on the motor-specific indicator lever individually or collectively.

8. The arrangement as claimed in claim 2, wherein a coupling element, connected directly or indirectly to the motor-drive-specific indicator entity, is useable to prevent any attempt by the motor drive to close the switch if the motor-drive-specific indicator entity displays a closure-unreadiness.

9. The arrangement as claimed in claim 2, wherein the switch-specific indicator entity is configured to interact with at least one further switch-specific actuator to move the switch-specific indicator entity into the "closure-unready" setting.

10. The arrangement as claimed in claim 9, wherein the switch-specific indicator entity includes a mechanical element configured to move the switch-specific indicator entity into the "closure-unready" setting when the handle or at least one of the at least one further mechanical actuator signals closure-unreadiness.

11. The arrangement as claimed in claim 2, wherein the motor-drive-specific indicator entity includes an indicator lever whose displacement angle indicates the display of the closure-readiness or the closure-unreadiness of the arrangement.

12. The arrangement as claimed in claim 11, wherein the motor-drive-specific indicator lever is pivoted into a "closure-unready" lever setting when the switch-specific indicator entity displays the closure-unreadiness of the switch.

13. The arrangement as claimed in claim 2, wherein the switch-specific indicator entity includes a first indicator element that indicates the closure-readiness of the switch and a second indicator element that indicates the closure-unreadiness of the switch, and said operating wall includes an indicator window through which either the first or second indicator element is visible from the outside of the housing.

14. The arrangement as claimed in claim 13, wherein the motor-drive-specific indicator entity includes an indicator lever whose displacement angle indicates the display of the closure-readiness or the closure-unreadiness of the arrangement.

15. The arrangement as claimed in claim 13, wherein the switch-specific indicator entity is configured to interact with at least one further switch-specific actuator to move the switch-specific indicator entity into the "closure-unready" setting.

16. The arrangement as claimed in claim 13, wherein the switch-specific indicator entity includes a switch-specific indicator lever whose displacement angle determines the display of the closure-readiness of the switch or the closure-unreadiness of the switch, wherein the motor-drive-specific indicator entity includes a motor-drive-specific indicator lever whose displacement angle determines the display of the closure-readiness of the arrangement or the closure-unreadiness of the arrangement, and wherein the motor-drive-specific indicator lever is coupled to the switch-specific indicator lever and pivoted into the "closure-unready" setting when the switch-specific indicator lever is pivoted into the "closure-unready" setting.

17. The arrangement as claimed in claim 13, wherein the motor-specific indicator lever is coupled to switch-related actuators which act on it individually or collectively.

18. The arrangement as claimed in claim 13, wherein a coupling element, connected directly or indirectly to the motor-drive-specific indicator entity, is useable to prevent any attempt by the motor drive to close the switch if the motor-drive-specific indicator entity displays a closure-unreadiness.

* * * * *